United States Patent [19]

Warren

[11] 4,401,161

[45] Aug. 30, 1983

[54] OIL WELL TOOL RETRIEVING DEVICE

[76] Inventor: Kenneth R. Warren, 4105 Walnut Dr., New Iberia, La. 70560

[21] Appl. No.: 339,972

[22] Filed: Jan. 15, 1982

[51] Int. Cl.[3] ..... E21B 17/00; E21B 31/107

[52] U.S. Cl. ..... 166/178; 175/300; 166/301

[58] Field of Search ..... 175/300–303; 166/178, 301

[56] References Cited

U.S. PATENT DOCUMENTS

| | | | |
|---|---|---|---|
| 1,989,907 | 2/1935 | Beck | 175/303 |
| 2,005,228 | 6/1935 | Kammerdiner | 175/303 |
| 2,158,406 | 5/1939 | Collett et al. | 175/303 X |
| 2,733,046 | 1/1956 | Thompson | 175/303 |
| 4,047,568 | 9/1977 | Aulenbacher | 166/301 X |

*Primary Examiner*—Stephen J. Novosad
*Assistant Examiner*—Joseph Falk
*Attorney, Agent, or Firm*—Harvey B. Jacobson

[57] ABSTRACT

An oil well tool retrieving device in the form of a jar is provided having a hollow casing including a downwardly facing impact surface, a hammer of cylindrical construction slidably engaging an inner surface of the casing and impacting with the impact surface in one direction and an upwardly facing casing impact surface in the other, a mandrel of cylindrical construction from which the hammer is supported slidably engaging an inner surface of the casing, a double track raceway formed in and extending along a length of the mandrel, resiliently mounted bearing elements supported from the casing and for engaging the double track raceway and a hump element mounted in one of the tracks of the double track raceway while the other track is a free raceway. The arrangement may be used to release and retrieve oil well tools by impact of the hammer on the upwardly facing casing surface during free fall of a sucker rod in a downward direction as bearing elements follow the free raceways and by impact of the hammer against the impact surface of the casing when the mandrel is suddenly released by the bearing elements passing over the hump elements during movement of the sucker rod in an upward direction.

7 Claims, 6 Drawing Figures

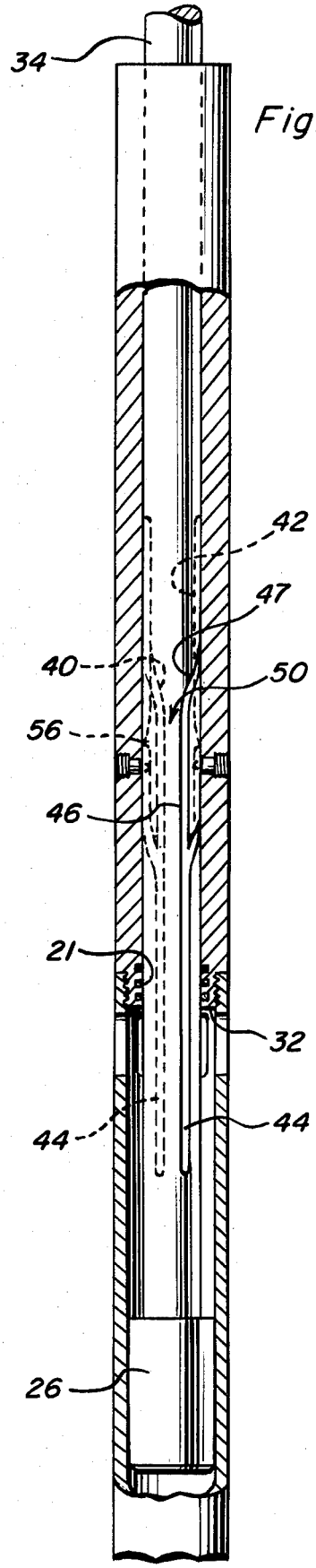
Fig. 4
Fig. 5
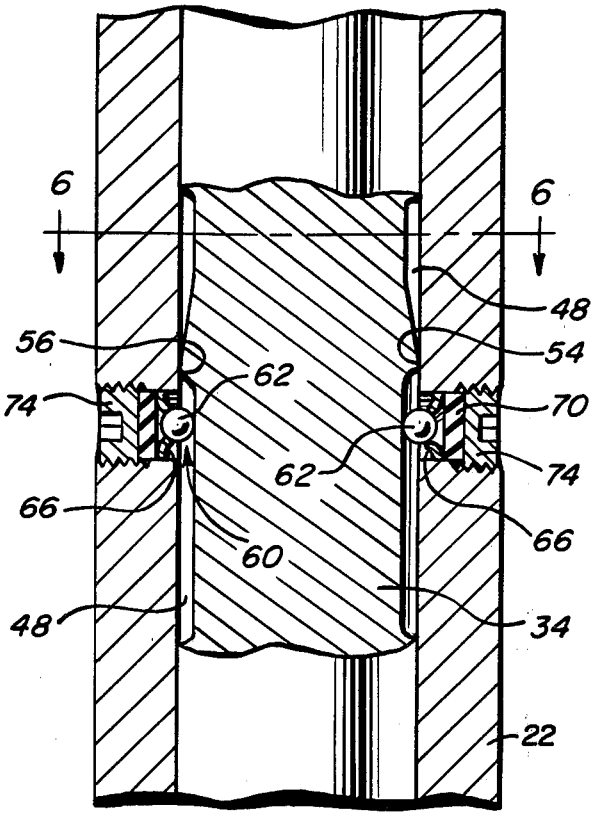
Fig. 6
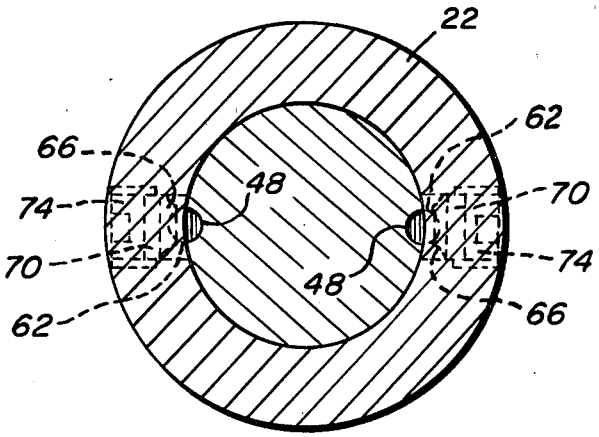

OIL WELL TOOL RETRIEVING DEVICE

BACKGROUND OF THE INVENTION

This invention relates to a system for the jarring of tools which are stuck in places, such as an oil well and the like, and which provides for the use of ball bearing and double raceway arrangements including a hump element contained in one of the raceways while the other raceway is free of hump elements. More particularly, the invention relates to an adjustment device for the ball bearing arrangement for adjustment of the bearing arrangement following along the raceway cut in a mandrel. The raceway is inlaid and coated with "Tuborium" or other hard metal finish or coating to provide for incurring minimum wear. In each raceway there is a high point or hump element which takes a various amount of pull for the bearing to jump over and this may be set at a desired pull by increasing the pressure on the bearing with an Allen set screw or screws and similarly by decreasing the pressure by loosening of the screws. The tool force is released for hammer-down action. The bearing element does not follow the high point or hump element raceway in resetting, but follows a free raceway of the double track raceway for downward jarring.

FIELD OF THE INVENTION

In the various phases of producing oil and gas from drilling to production, oil tools, such as squeeze, surge, perforation, wash, bridge plugs, packers, drill pipe, and the like, may become stuck in the well shaft. Similarly, it is found that in other restricted places and environments, tools often may become frozen or stuck in its working space and when this occurs, it is sometimes necessary to go in the well or its working space to retrieve the tools with various finishing tools, overshots with grapples, taper taps, and the like. These finishing tools are usually accompanied by oil jars and bumper jars. Oil jars hammer up and bumper jars hammer down.

A fishing bump or bumper sub-assembly may consist of a mandrel, a mandrel body, a knocker and a top sub and seal assembly. All of the sub-assembly is generally manufactured from high strength, heat treated alloy steels for enabling the tool to withstand the severe bumping shock, tension and torque to which it is subjected.

To make up a proper fishing string, it is necessary that a bumper sub be included as one of the components of the string which provides a down bump. To provide a jar upwardly, a hydraulic rod jar is added as an additional component to the string so that by proper manipulation of the string, it is possible to jar up, jar down or both one at a time. Intensity of the blow is determined by the handling of the run-in string which is under complete control of the driller at all times.

Downward blows and jars are struck by first elevating the string to make sure the bumper sub is fully open. The brake is released and the block is allowed to fall a distance equal to the stroke of the bumper sub. The downwardly travelling pipe closes the bumper sub quickly, thus delivering a downward blow or jar.

Upward blows or jars are struck by simply taking a stretch in the pipe, then releasing the brake and allowing the block to fall a distance equal to a stretch previously taken in the pipe. The brake is then set. The downwardly travelling string partially closes the bumper sub. Spring back of the pipe opens the bumper sub quickly, thus delivering an upward blow.

The upstroke of oil jars occurs when there is sufficient oil forced by a brass piston through the compensating piston from the top chamber of the jar to the lower chamber thereof. This is obtained with about 20,000 pounds of pull for a period of approximately five minutes. When enough oil has exchanged chambers, free fall will occur causing hammer action of the hammer element for jarring and possibly causing release of the end of the stuck tool. When this occurs, the weight is then set on the oil jar to reset for another jarring. When weight is applied downward, the bumper jar is hammered down for action in that direction. This is repeated as necessary to free the tool.

While many separate downward and upward jar devices are provided in known tool structures and devices, the present invention provides a unitary device having both downward bump or jar and controlled upward jar capability not generally heretofore known in the art.

Further, the unitary device is provided with a common raceway at the ends and having a double path intermediate the ends, one for free fall and the other for controlled upward jar action.

Where two tools are usually required in a fishing operation, the jar arrangement of the present invention will serve for both operations, namely, oil and bumper jars.

DESCRIPTION OF THE PRIOR ART

Various jarring tools utilizable in oil wells are known and U.S. patents exemplary of some prior art arrangements are: McCullough U.S. Pat. No. 1,848,535; Beck U.S. Pat. No. 1,989,906; Gaitzsch U.S. Pat. No. 2,204,458; Lowe U.S. Pat. No. 2,562,321; and Sutliff et al U.S. Pat. No. 4,186,807.

The McCullough and Beck patents disclose mechanical release devices with McCullough providing both a hammer up and hammer down arrangement and Beck disclosing the use of ball detents and a shoulder with a resistance characteristic being adjusted by a nut. None of these disclosures provide for use of bearings elements and double track raceway arrangements having a high point or hump contained in one of the raceways and the other raceway being a free raceway. Thus, none of these disclosures, whether considered singly or in combination with each other, are believed to have a bearing on the patentability of any claims of this invention.

SUMMARY OF THE INVENTION

A feature and object of the present invention to provide apparatus to retrieve tools and work elements in tight spaces or oil well shafts.

Another object of the present invention to provide a bearing element such as a ball bearing element passing a high point or hump element in a double track raceway for use in slop jars as well as other tools.

A further object and advantage of the present invention to provide ball bearings selectively forced against a mandrel of a tool by tightening or loosening set screws.

It is an object and advantage of the invention that, where two tools are required in an operation for releasing stuck tools, means are provided that will serve for both operations, such as oil and bumper jars. Although the slop jar of the invention may have a basic common appearance, it does not work with oil but with ball bearings forced against a mandrel of the tool and in which the ball bearings follow along a raceway cut in the mandrel. The raceway is provided with an inlaid coating or layer comprising "Tuborium" or other hard metal surfaces for preventing the raceway from incurring wear.

An additional object of the invention is to provide in the raceway a high point or hump which takes a various amount of force or pull for the ball bearings to jump over the high point and for the hammer and mandrel to achieve free fall and provide its hammer action. The high point and the bearing elements may be set at desirable relationships according to the invention, so that there is a set and desired pull by selectively increasing or decreasing the pressure on the bearings by adjustment of Allen set screws. The bearing does not follow the high point raceway when resetting, but follows the free raceway for downward jarring.

A further and additional object of the invention is to provide structural arrangements to perform a similar operation with a slop jar, simply by providing means to adjust Allen screws without the disadvantage of the prior art of this assembly requiring a disassembly and reassembly in order to provide some adjustment of the flow of oil from an upper chamber to a lower chamber, such as is required to reset the desired pull on present jars and similar devices of the known prior art.

Additionally it is a feature and advantage of the present invention to provide high point configurations or humps for engaging bearing members, such as ball bearings, for use in slop jars as well as other similar and related tools.

These together with other objects and advantages which will become subsequently apparent reside in the details of construction and operation as more fully hereinafter described and claimed, reference being had to the accompanying drawings forming a part hereof, wherein like numerals refer to like parts throughout.

BRIEF DESCRIPTION OF THE DRAWINGS

FIG. 4 is a side elevational view, part of which is broken away, and showing a hammer and mandrel having the dual track raceway therein.

FIG.5 is an enlarged sectional view of the tool of the invention showing a high point or hump element along one part of the raceway and in which a bearing member with an adjustment means is provided for selectively increasing or decreasing pressure applied to the mandrel by the bearing member.

FIG. 6 is a sectional view taken along the line 6—6 of FIG. 5.

DESCRIPTION OF THE PREFERRED EMBODIMENT

Figure 1:
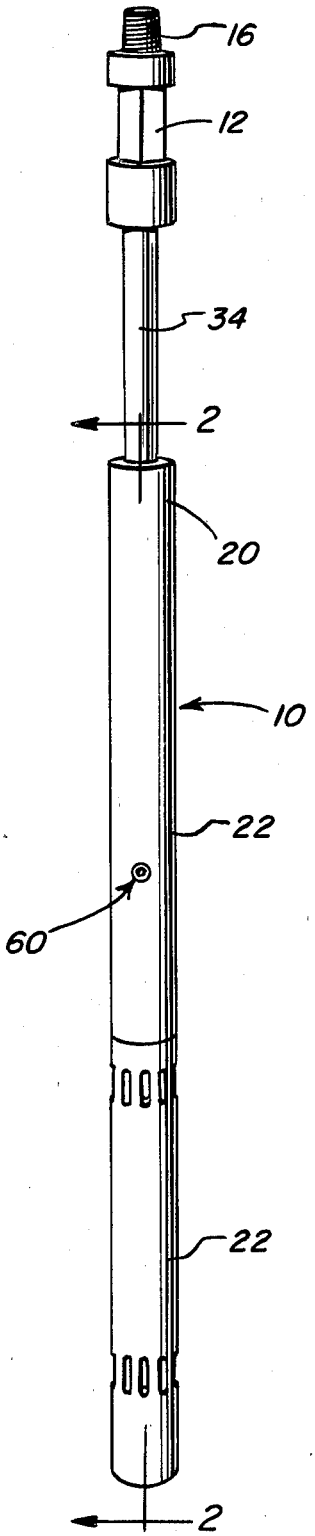
FIG. 1 is a perspective view of an improved oil well tool retrieving device according to a preferred and best mode of the present invention.

Referring now to the drawings, there is shown an oil well retrieving device 10 having a sucker rod segment 12 including a pin coupling member 16 at the upper end for connecting to a sucker rod or drill string (not shown). Depending from and forming a continuation of the sucker rod segment 12 is a mandrel 34 having a diametrically enlarged hammer 26 on the lower end thereof. The hammer 26 and the mandrel 34 are telescopically slidably received in a casing 22 which includes upper and lower threadingly joined upper and lower portions 23 and 25 and has a box coupling member 14 at its lower end for connection with a fishing tool or lower portions of the sub-assembly, drill string or the like. The upper and lower ends of the upper portion of casing 22 include seals 21 which prevent entry of material between the casing 22 and mandrel 34. The mandrel 34 slidably engages the inner surface 24 of the casing 22 and the latter defines a downwardly facing lower impact surface 32 for upward impact of the hammer 26 thereagainst in a manner described hereinafter. The hammer 26 will impact surface 33 when the mandrel moves to its lowermost position.

Figure 2:
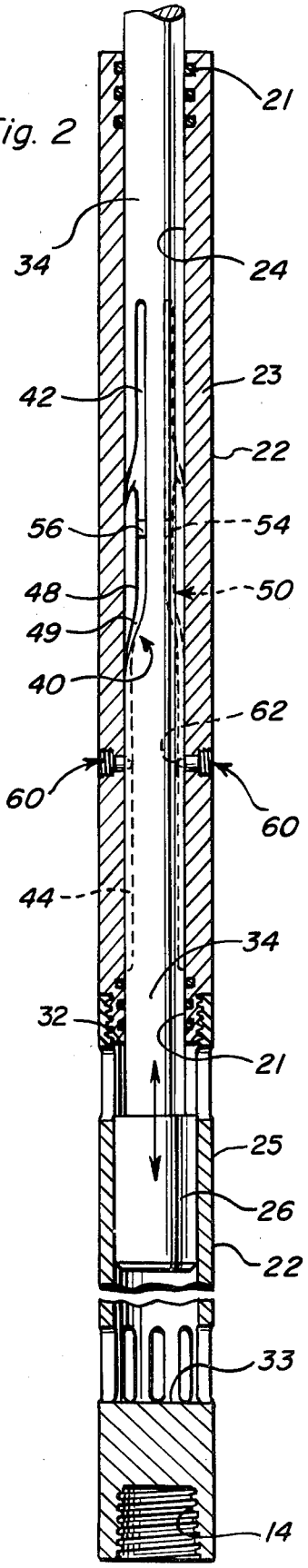
FIG. 2 is a generally sectional and enlarged view taken along the line 2—2 of FIG. 1.
Figure 3:
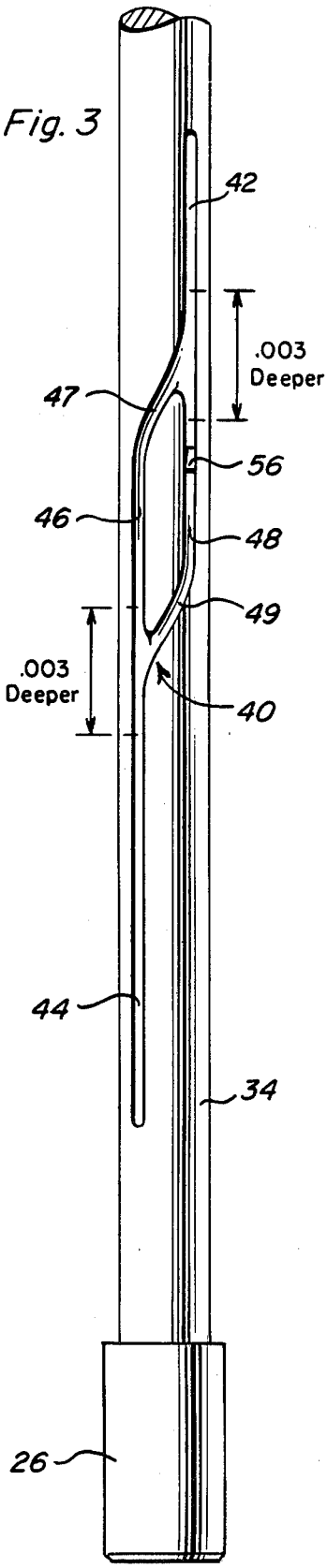
FIG. 3 is an enlarged side elevational view of a hammer and mandrel of FIG. 2 showing a dual track raceway according to an embodiment of the invention.

There is shown in detail in FIG. 3 the hammer 26 and the mandrel 34. The mandrel is constructed to contain a raceway 40 having an upper longitudinal track 42, a lower longitudinal track 44 offset circumferentially from the upper track and double track connecting raceways 46, 48 with raceway 46 aligned with lower track 44 and raceway 48 aligned with upper track 42 and an angled raceway 47 interconnects raceway 46 with track 42 and angled raceway 49 interconnects raceway 48 and track 44. On an opposite side of the mandrel 34 there is a corresponding and symmetrical arrangement of a double track raceway 50 similar to double track raceway 40, as shown in FIG. 2 and partially in FIG. 5.

The double track raceways 40, 50 are symmetrically disposed along opposite sides of the mandrel and comprise a common length and dimension to each other. In each of the raceways 40, 50 there is provided a high point or hump element 54, 56 shown in FIG. 4 and in which only hump element 56 is shown in FIG. 3. The hump elements 54, 56 are constructed in the raceway 48 of each of the raceways 40, 50, while the other raceway 46 which provides a return path is a free raceway as seen in the drawings.

A bearing element or means 60 supported from casing 22 is disposed for engagement with each of the symmetrically arranged double track raceways 40, 50, and as shown in FIGS. 5 and 6, the bearing means 60 consists of a ball bearing 62 mounted on bearing seats 66, each of which rests on a rubber pad or resilient material pad 70 which in turn engages an adjustment member such as an Allen set screw 74.

The ball bearings 62 are forced against the mandrel 34 of the tool by selectively tightening or loosening the Allen set screws 74. The ball bearings follow the raceway 40, 50 in the mandrel 34 as described above. There is provided along the length of the raceway an inlaid coating or surface finishing layer inlaid with a hardening material, such as "Tuborium", a trade name for a hard metal finish coating, so that the friction between the bearing and the raceway incurs substantially minimum wear.

The hump elements 54, 56 described above will require a predetermined force or pull for the ball bearings 62 to move over the hump element to allow rapid upward acceleration of the hammer for impact of the hammer with the impact surface 32. This force may be accordingly set at a desired level by increasing pressure on the ball bearings 62 with the above-mentioned selective adjustment of the Allen set screws. The ball bearings 62 follow the raceways 46 and 47 on resetting and for downward jarring when the hammer 26 impacts against surface 33. For resetting and for performing repeated operational steps, one continues with the same steps or if adjustments is desired, one need merely to simply adjust the Allen set screws to a desired position for loosening or increasing the pressure on the bearing member. Disassembly of the housing for readjustment is not necessary or required The above description discloses a new and improved oil well tool retrieving device and the like for use in jarring in wells and with other stuck tools and in which there is a provided a bearing structure engaging a track raceway having a hump element in one of the raceways for achieving the objects and advantages of the present invention.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. An oil well tool retrieving device including an upstanding cylindrical casing defining a downwardly facing impact surface, an elongated mandrel slidingly and rotatably received within said casing and including upwardly facing hammer means engageable with said downwardly facing impact surface to establish an upper limit of movement of said mandrel relative to said casing, said casing and mandrel including coacting limit means engageable with each other to establish a lower limit of movement of said mandrel relative to said casing, said mandrel and casing including coacting yieldable intermediate stop means operative to releasably restrict upper movement of said mandrel past an intermediate position disposed between said lower and upper limit positions and to effect a sudden free release of said mandrel for subsequent free upward movement from said intermediate position toward said upper limit position upon an upward thrust on said mandrel relative to said casing above a predetermined high thrust value, said stop means including a double track raceway including a pair of generally parallel tracks extending longitudinally of said mandrel and rotary bearing means carried by said casing guidingly engaged in said raceway, one of the tracks of said raceway including hump means, means supporting said bearing means from said casing for shifting radially thereof and force means operatively connected between said casing and bearing means yieldably biasing said bearing means radially inwardly of said casing into tight seated engagement in said raceway, said raceway including angled tracks interconnecting corresponding end portions of said parallel tracks whereby full upward movement of said spindle will shift said bearing means from said one track to the other of said parallel tracks and full downward movement of said spindle relative to said casing will shift said bearing means from said other parallel track to said one parallel track, said hump means being disposed in said one parallel track intermediate the zones thereof into which said angled tracks open.

2. The oil well tool retrieving device of claim 1 wherein said stop means includes adjustment means operative to adjust the biasing force acting upon said bearing means by said force means.

3. The oil well tool retrieving device of claim 2 wherein said adjustment means includes adjustment members threadedly supported from said casing and adjustable from the exterior of the latter.

4. The oil well tool retrieving device of claim 1 wherein said coacting limit means engageable with each other to establish a lower limit of movement of said mandrel relative to said casing includes a downwardly facing hammer surface on said mandrel and an upwardly facing abutment surface on said casing downwardly abuttingly engageable by said hammer surface.

5. The oil well tool retrieving device of claim 1 wherein said double track raceway is inlaid with a hardened material.

6. The oil well tool retrieving device of claim 1 wherein said casing includes threaded coupling means to selectively assemble and disassemble the retrieving device for maintenance, repair and inspection.

7. The oil well tool retrieving device of claim 1 wherein the upper end of said mandrel includes means for connecting to a string and line means and the lower end of said casing includes means for connecting to an object to be jarred and retrieved by said device.

* * * * *